US007686624B2

(12) United States Patent
Mason et al.

(10) Patent No.: US 7,686,624 B2
(45) Date of Patent: Mar. 30, 2010

(54) ELECTRICAL CONNECTOR WITH CONTACT SHORTING PATHS

(75) Inventors: Jeffrey W. Mason, North Attleboro, MA (US); Wayne S. Alden, III, Whitman, MA (US); Peter D. Wapenski, Foster, RI (US)

(73) Assignee: Tyco Electronics Corporation, Middletown, PA (US)

( * ) Notice: Subject to any disclaimer, the term of this patent is extended or adjusted under 35 U.S.C. 154(b) by 52 days.

(21) Appl. No.: 11/865,788

(22) Filed: Oct. 2, 2007

(65) Prior Publication Data

US 2009/0088005 A1 Apr. 2, 2009

(51) Int. Cl.
*H01R 4/58* (2006.01)

(52) U.S. Cl. ..... 439/91

(58) Field of Classification Search ..... 439/91, 439/66, 74, 86, 591; 174/260; 361/744
See application file for complete search history.

(56) References Cited

U.S. PATENT DOCUMENTS

| | | | | |
|---|---|---|---|---|
| 5,599,193 | A | 2/1997 | Crotzer | |
| 6,271,482 | B1 | 8/2001 | Crotzer et al. | |
| 6,348,659 | B1 | 2/2002 | Crotzer et al. | |
| 6,394,853 | B1 * | 5/2002 | Hammond et al. | 439/676 |
| 6,669,490 | B1 | 12/2003 | DelPrete et al. | |
| 6,790,057 | B2 | 9/2004 | DelPrete et al. | |
| 6,796,810 | B2 * | 9/2004 | DelPrete et al. | 439/86 |
| 6,854,985 | B1 * | 2/2005 | Weiss | 439/91 |
| 7,070,420 | B1 | 7/2006 | Wakefield et al. | |
| 2004/0029411 | A1 * | 2/2004 | Rathburn | 439/66 |

* cited by examiner

*Primary Examiner*—Alexander Gilman

(57) ABSTRACT

An electrical connector includes an insulator holding a plurality of contacts in an array corresponding to an array of pads on an electronic device. At least one shorting path electrically connects at least two of the contacts in the array. The insulator includes a plurality of apertures therethrough, with each aperture defining a contact location on the insulator. The insulator includes a channel formed between at least two contact locations. The channel defines a location of a shorting path and the shorting path is at least partially within the insulator.

20 Claims, 2 Drawing Sheets

ELECTRICAL CONNECTOR WITH CONTACT SHORTING PATHS

BACKGROUND OF THE INVENTION

The invention relates generally to surface mounted connectors, and more specifically, to an electrical connector having contacts arranged in a grid for mating with pads on an electrical device.

The ongoing trend toward smaller, lighter, and higher performance electrical components and higher density electrical circuits has led to the development of surface mount technology in the design of printed circuit boards and electronic packages. As is well understood in the art, surface mountable packaging allows for the connection of the package to pads on the surface of the circuit board rather than by contacts or pins soldered in plated holes going through the circuit board. Surface mount technology allows for an increased component density on a circuit board, thereby saving space on the circuit board.

The ball grid array (BGA) and land grid array (LGA) are two types of surface mount packages that have been developed in response to the demand created by higher density electrical circuits for increased density of electrical connections on the circuit board. The ball grid array includes an array of connections on the bottom side of the package. In the ball grid array, pins extending into the circuit board are replaced by small solder balls placed on the bottom side of the package at each contact location. The circuit board, rather than having holes, has an array of contact pads matching the solder ball placements on the package bottom. Connections are made by reflow soldering the solder balls to mechanically and electrically engage the package to the circuit beard. The land grid array is similar to the ball grid array except that, rather than the application of solder balls, a land grid array socket applies sufficient normal force on the package to mate the package on flexible contact beams in a connector.

BGA and LGA technology offer the advantages of higher connection densities on the circuit board and higher manufacturing yields which lower product cost. However, they are not without disadvantages. In particular, during the development of chips, chip sockets, multi-chip modules (MCM's), and other electronic packages using BGA technology, the resolution of errors of faults requires soldering and unsoldering of the packages which, in the case of ball grid array devices, is particularly difficult. To aid in problem diagnosis, shorting bridges are sometimes used to short between solder balls. However, shorting bridges are expensive to manufacture and difficult to implement.

A need exists for a connector that can be easily and economically manufactured and which enables errors or faults between contacts to be simulated to facilitate the resolution of actual faults and errors.

BRIEF DESCRIPTION OF THE INVENTION

In one embodiment, an electrical connector is provided. The connector includes an insulator holding a plurality of contacts in an array corresponding to an array of pads on an electronic device. At least one shorting path electrically connects at least two of the contacts in the array.

Optionally, the insulator includes a plurality of apertures therethrough, with each aperture defining a contact location on the insulator. The insulator includes a channel formed between at least two contact locations. The channel defines a location of a shorting path and the shorting path is at least partially within the insulator. Each of the plurality of contacts and each shorting path are formed from a conductive polymer.

In another embodiment, a socket connector is provided that includes a dielectric housing that holds an insulator. The insulator includes a plurality of contacts in an array corresponding to an array of pads on an electronic device. At least one shorting path electrically connects at least two of the contacts in the array.

DETAILED DESCRIPTION OF THE INVENTION

Figure 1:
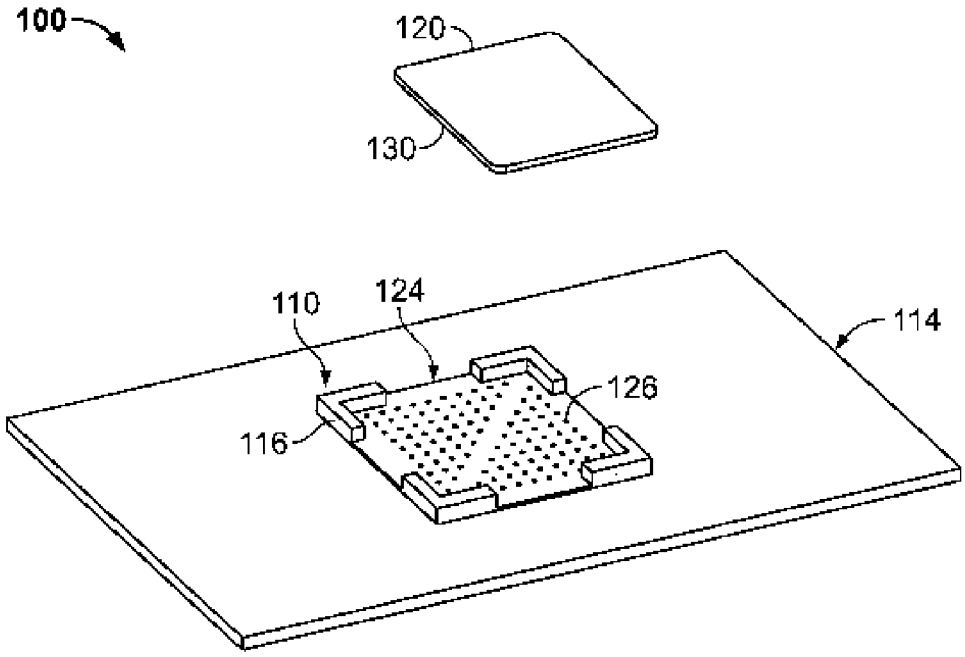
FIG. 1 is an exploded view of an electronic assembly including a socket connector having an interconnect member formed in accordance with an exemplary embodiment of the present invention.

FIG. 1 illustrates an electronic assembly 100 including a socket connector 110 formed in accordance with an exemplary embodiment of the present invention. The socket connector 110 is mounted on a circuit board 114. An electronic package 120 is loaded onto the socket connector 110. When loaded onto the socket connector 110, the electronic package 120 is electrically connected to the circuit board 114. The electronic package may be a chip or module such as, but not limited to, a central processing unit (CPU), microprocessor, or an application specific integrated circuit (ASIC), or the like. While the invention will be described in terms of a land grid array (LGA) package, it is to be understood the inventive concepts described herein may be applied to other types of packages such as for evaluating ball grid array (BGA) devices prior to application of solder balls. The following description is for illustrative purposes only and no limitation is intended thereby.

The socket connector 110 includes a dielectric housing 116 that is configured to be mounted on the circuit board 114. The housing 116 holds an interconnect member 124 formed in accordance with an exemplary embodiment of the present invention. The interconnect member 124 includes a plurality of electrical contacts 126. The electronic package 120 has a mating surface 130 that engages the interconnect member 124. The interconnect member 124 is interposed between contact pads (not shown) on the mating surface 130 of the electronic package 120 and corresponding contact pads (not shown) on the circuit board 114 to provide electrical paths to electrically connect the electronic package 120 to the circuit board 114.

Figure 2:
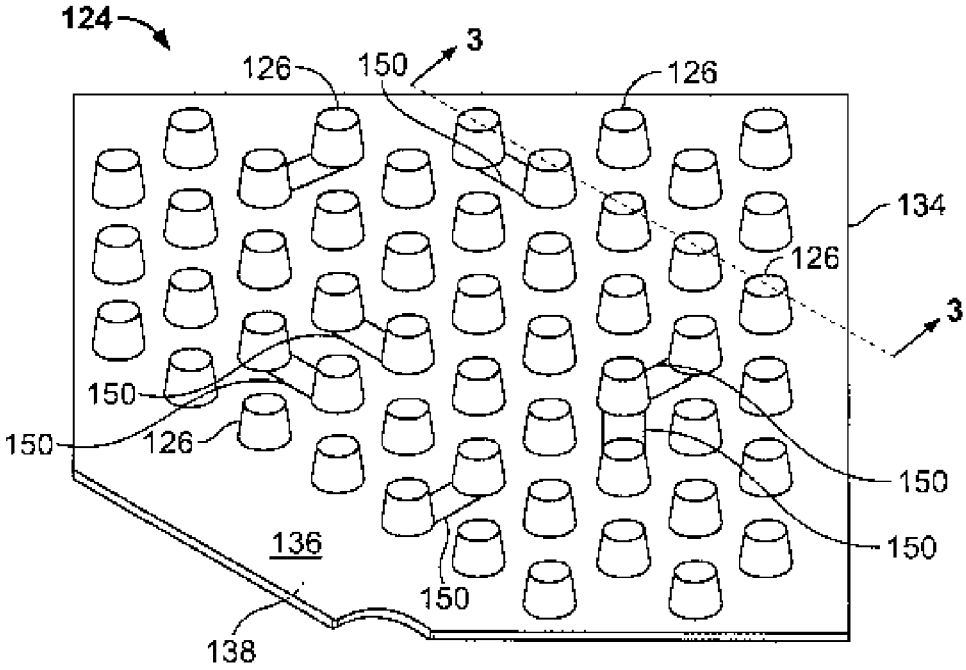
FIG. 2 is an enlarged view of a portion of the interconnect member shown in FIG. 1.
Figure 3:
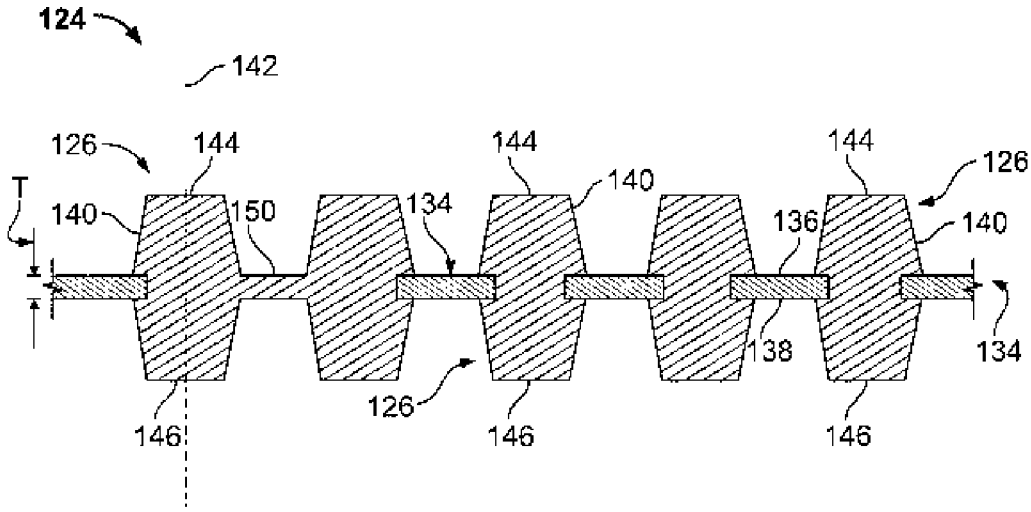
FIG. 3 is a cross-sectional view of the interconnect member taken along the line 3-3 in FIG. 2.

FIG. 2 illustrates an enlarged view of a portion of an inter connect member 124 formed in accordance with an exemplary embodiment of the present invention. FIG. 3 illustrates a cross-sectional view of the interconnect member 124 taken along the line 3-3 in FIG. 2. The interconnect member 124 includes an insulator or carrier 134 on which the contacts 126 are arranged. Each contact 126 comprises a column formed from a conductive polymer and is held in the insulator 134. In one embodiment, the conductive polymer is a metallized polymer such as a blend of a polymer and silver powder. In other embodiments, polymers mixed with other conductive materials may be employed. The insulator 134 is a substantially planar sheet of non-conductive material having a thickness T between a first side 136 and an opposite second side 138. In one embodiment, the first and second sides 136 and 138 are substantially parallel to one another. Each contact 126 includes an elongated contact body 140 that extends along a longitudinal axis 142 between first and second opposite ends 144 and 146. The first end 144 extends from the first side 136 of the insulator 134 and a second end 146 extends from the second side 138 of the insulator 134. When the interconnect member 124 is interposed between the electronic package 120 and the circuit board 114, the contacts 126 provide electrical paths between contact pads (not shown) on the electronic package 120 and corresponding contact pads (not shown) on the circuit board 114.

Paths 150 of conductive polymer material are formed in the insulator 134 and extend between two or more pre-selected contact locations in the insulator 134. The paths 150 of conductive polymer material form shorting paths 150 between the selected contact locations. The shorting paths 150 effectively short together the contacts 126 along the shorting paths 150 thereby enabling the simulation of solder defects to facilitate the resolution of actual faults and errors as will be described. In an exemplary embodiment, the shorting paths 150 are molded in the insulator 134 and are formed of the same conductive polymer material as the contact 126. The shorting paths 150 are molded onto the insulator 134 simultaneously with the contacts 126 and thus are unitarily formed with the contacts 126.

Figure 4:
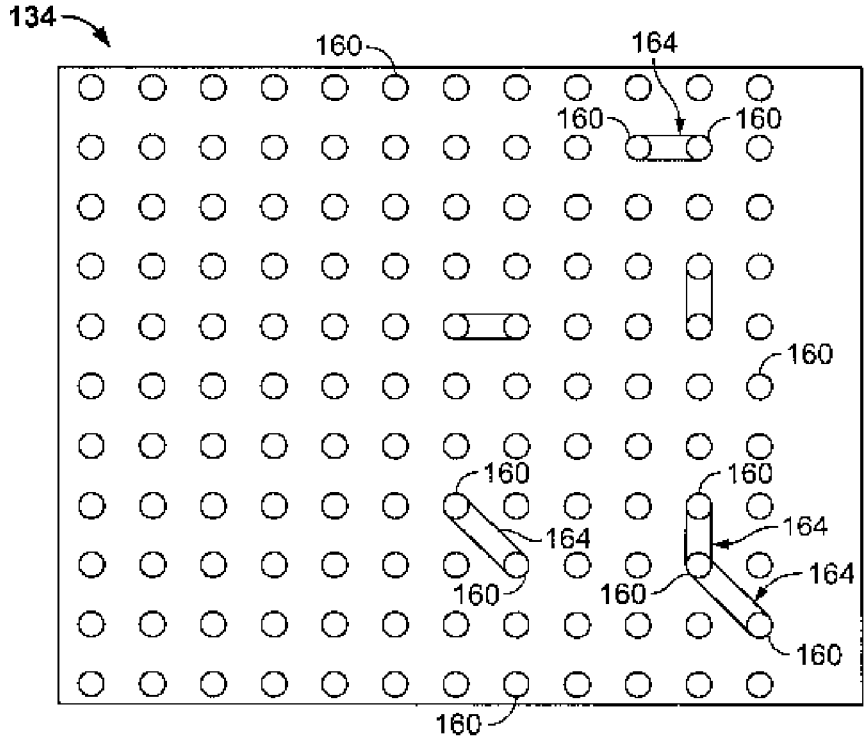
FIG. 4 is a top plan view of the insulator shown in FIG. 2.

FIG. 4 illustrates a top plan view of the insulator 134. The insulator 134 is formed with a plurality of contact apertures 160 therethrough that define contact locations on the insulator 134. The apertures 160 may be formed by an etching, drilling, or die cutting process or other known methods. The contacts 126 (FIG. 3) are molded onto the insulator 134 and extend through the insulator at the contact apertures 160. Shorting channels 164 are formed in the insulator 134 that interconnect two or more pre-selected contact apertures 160. The shorting channels 164 extend at least partially through the insulator 134 and define locations for conductive polymer material that defines the shorting paths 150 (FIG. 2) in the insulator 134. In one embodiment, the channels 164 are cut completely through the insulator 134. In an exemplary embodiment, the insulator 134 is fabricated from a flexible polyimide material, and more specifically, the insulator 134 may be fabricated from a polyimide material that is commonly known as Kapton® which is available from E.I. du Pont de Nemours and Company.

With reference to FIGS. 2, 3, and 4, the interconnect member 124 enables solder fault testing of connectors and electronic packages or chips to be economically performed. During solder fault testing, shorts at specific contact locations may be simulated and the results tracked. The simulated data can then be used to diagnose malfunctions and identify possible solder problem locations. In an exemplary embodiment, the interconnect member 124 is fabricated using a transfer molding process wherein all of the contacts 126 are molded at one time. The shorting paths 150 are formed within the insulator 134 so that separate molds are not required for each shorting scenario.

The contact apertures 160 are formed in the insulator 134 in a pattern that is complementary to the contact pad patterns (not shown) on the electronic package 120 and the circuit board 114 (FIG. 1). Shorting channels 164 are then cut or routed in the insulator 134 between contact apertures 160 selected for a particular shorting scenario. The contacts 126 and shorting paths 150 are then simultaneously molded on the insulator 134 to complete the fabrication of the interconnect member 124.

The embodiments thus described provide a connector that is particularly useful in solder fault testing involving tracking of solder ball shorts and their effects on an associated electronic package. The connector can be economically manufactured and provides the capability to simulate solder faults between pre-selected contact locations. Results from the simulated fault testing are tracked and used to identify and resolve actual faults and errors in the electronic package.

While the invention has been described in terms of various specific embodiments, those skilled in the art will recognize that the invention can be practiced with modification within the spirit and scope of the claims.

What is claimed is:

1. An electrical connector comprising:

an insulator holding contacts in an array corresponding to an array of pads on an electronic device, each of said contacts comprising a column of a conductive polymer; and a shorting path electrically connecting at least two of said contacts in the array, said shorting path formed from said conductive polymer, wherein said at least two of said contacts extend from a first side of said insulator to contact ends that protrude past said first side of said insulator farther than said shorting path.

2. The electrical connector of claim 1, wherein said insulator includes a channel formed between said at least two of said contacts, said channel defining a location of said shorting path.

3. The electrical connector of claim 1, wherein each said contact includes a body having a first end protruding from said first side of said insulator and a second end extending from an opposite second side of said insulator.

4. The electrical connector of claim 1, wherein said conductive polymer comprises a metallized polymer.

5. The electrical connector of claim 1, wherein said shorting path is unitarily formed with at least one of said contacts.

6. The electrical connector of claim 1, wherein the conductive polymer comprises a blend of a dielectric polymer and a conductive material.

7. The electrical connector of claim 1, wherein said insulator has a thickness extending between said first side and an opposite second side, and said shorting path is disposed entirely within said thickness.

8. The electrical connector of claim 1, wherein said shorting path and said at least two of said contacts are a unitary body formed from said conductive polymer.

9. The electrical connector of claim 1, wherein said insulator has a thickness extending between said first side and an opposite second side, and said shorting path extends through said thickness of said insulator from said first side to said second side.

10. A socket connector comprising:

a dielectric housing;

an insulator held in said housing, said insulator holding contacts in an array corresponding to an array of pads on an electronic device; and a shorting path including a conductive polymer, the shorting path electrically connecting at least two of said contacts in the array, wherein said insulator has a thickness extending between a first side and an opposite second side, and said shorting path is disposed entirely within said thickness.

11. The socket connector of claim 10, wherein said insulator includes a channel extending into said thickness of said insulator from at least one of said first side and said second side, said channel formed between said at least two of said contacts and defining a location of said shorting path.

12. The socket connector of claim 10, wherein each of said contacts comprises a column of a conductive polymer.

13. The socket connector of claim 12, wherein each said column includes a first end protruding from said first side of said insulator and a second end protruding from said second side of said insulator.

14. The socket connector of claim 12, wherein said conductive polymer comprises a metallized polymer.

15. The socket connector of claim 10, wherein said shorting path is formed from the conductive polymer.

16. The socket connector of claim 10, wherein said shorting path is unitarily formed with at least one of said contacts.

17. The socket connector of claim 10, wherein the conductive polymer comprises a blend of a dielectric polymer and a conductive material.

18. The socket connector of claim 10, wherein said at least two of said contacts extend from said first side of said insulator to contact ends that protrude past said first side of said insulator farther than said shorting path.

19. The socket connector of claim 10, wherein said shorting path and said at least two of said contacts are a unitary body formed from said conductive polymer.

20. The socket connector of claim 10, wherein said shorting path extends through said thickness of said insulator from said first side to said second side.

* * * * *